United States Patent [19]

Sulzberger

[11] Patent Number: 4,870,734

[45] Date of Patent: Oct. 3, 1989

[54] METHOD OF MANUFACTURING HIGH EFFICIENCY HEAT EXCHANGE TUBE

[75] Inventor: Kevin J. Sulzberger, Orange, Calif.

[73] Assignee: TUI Industries, Placentia, Calif.

[21] Appl. No.: 290,864

[22] Filed: Dec. 28, 1988

Related U.S. Application Data

[63] Continuation of Ser. No. 34,786, Apr. 3, 1987, abandoned.

[51] Int. Cl.[4] ..... B21D 53/02

[52] U.S. Cl. ..... 29/157.3 R; 29/157.3 H; 29/157.4; 29/726

[58] Field of Search ..... 29/157.3 R, 157.3 H, 29/726, 157.4; 165/104.19

[56] References Cited

U.S. PATENT DOCUMENTS

| | | | |
|---|---|---|---|
| 1,597,618 | 8/1926 | Priser . | |
| 2,893,701 | 7/1959 | Bell . | |
| 3,299,417 | 1/1967 | Sibthorpe . | |
| 3,566,815 | 3/1971 | Roeder, Jr. . | |
| 3,626,987 | 12/1971 | Bittner . | |
| 3,677,329 | 7/1972 | Kirkpatrick | 29/157.3 H |
| 3,706,343 | 12/1972 | Saiga et al. . | |
| 3,769,674 | 11/1973 | Droughton et al. | 29/157.3 H |
| 3,803,688 | 4/1974 | Peck | 29/157.3 H |
| 3,830,290 | 8/1974 | Thamasett et al. . | |
| 4,210,199 | 7/1980 | Doucette et al. . | |
| 4,228,848 | 10/1980 | Wadkinson, Jr. . | |
| 4,265,094 | 5/1981 | Haasis, Jr. . | |
| 4,293,323 | 10/1981 | Cohen | 62/238.6 |
| 4,466,481 | 8/1984 | Wilson et al. . | |
| 4,635,711 | 1/1987 | Clark, Jr. . | |
| 4,637,218 | 1/1987 | Tchernev . | |

FOREIGN PATENT DOCUMENTS

| | | | |
|---|---|---|---|
| 0052522 | 5/1982 | European Pat. Off. . | |
| 0066425 | 12/1982 | European Pat. Off. . | |
| 0120497 | 10/1984 | European Pat. Off. . | |
| 1501531 | 6/1972 | Fed. Rep. of Germany . | |
| 0039246 | 3/1979 | Japan | 29/157.3 H |
| 0067794 | 4/1982 | Japan | 29/157.3 H |
| 0088594 | 5/1983 | Japan | 29/157.3 H |
| 0676851 | 7/1979 | U.S.S.R. | 29/157.3 H |

*Primary Examiner*—Howard N. Goldberg
*Assistant Examiner*—Irene Cuda
*Attorney, Agent, or Firm*—Scherlacher, Mok & Roth

[57] ABSTRACT

A high thermal efficiency multi-wall heat exchange tube is sealed at one end and has the gap between the tube walls filled with a silicon liquid oil that is nontoxic, has a boiling point above that of water, and increases heat transfer efficiency between the inner and outer walls of the tube. The liquid oil is inserted into the gap between the tube walls by placing the tube into a fixture which receives ten tubes simultaneously, heating the tube and the oil, evacuating the gap and inserting oil into the evacuated gap. The fixture includes a manifold connector assembly which is sealingly positioned over the open end of the one or more tubes to provide a manifold connection between the gap of each tube being filled and a source of vacuum as well as a source of oil and a drain. A hydraulic ram facilitates connection and removal of the manifold connector assembly.

8 Claims, 4 Drawing Sheets

METHOD OF MANUFACTURING HIGH EFFICIENCY HEAT EXCHANGE TUBE

This is a continuation of co-pending application Ser. No. 034,786, filed on Apr. 3, 1987, abandoned.

BACKGROUND OF THE INVENTION

As energy costs rise it is becoming increasingly necessary for industry to minimize these costs in order to become and remain competitive. One way of reducing energy costs is to use waste energy which is a by-product of one activity in another activity. For example a heat exchanger can be used to receive two fluids and transfer heat energy from one of the fluids to another. Thus, instead of wasting the heat energy in the first fluid and using more energy to heat the second fluid, the same heat energy is used two or more times.

Such heat exchangers typically employ a plurality of heat exchange tubes which carry one fluid on the inside thereof and are exposed to the second fluid on the outside thereof. If the walls of the heat exchange tubes are made of a thermally conductive material such as copper or some other metal, heat readily passes through the walls of the tube from the warmer fluid to the cooler fluid. Typical examples of heat exchangers employing such tubes are shown in European patent application No. 66,425 A3 and European patent application No. 120,497. In each of these heat exchanger arrangements a plurality of heat exchange tubes are nested inside a container while first and second fluids are directed through the container to improve heat transfer efficiency.

Where heat from a toxic heat exchange fluid such as a refrigerant is to be exchanged with a consumable fluid such as potable water, safety or code requirements frequently demand the use of a multi-walled heat exchange tube. To be effective or comply with code requirements a gap must be maintained between adjacent tube walls so that if a leak develops in one wall the leaking fluid will flow through the gap to the exterior of the tube where it can be detected. At the same time, the second wall maintains the leaking fluid separated from the other fluid. For certain applications it becomes necessary to further improve safety by using a triple wall tube. When a triple wall tube is used, two heat exchange fluids can become mixed only if all three walls develop a leak simultaneously.

While the use of multi-walled heat exchange tubes significantly increases the safety of a heat exchanger, the efficiency of heat transfer between the two fluids is significantly impaired. The tubes themselves can be made of a relatively good heat conductive material. However, the gap between the tubes becomes a thermal insulator and significantly reduces heat transfer efficiency of a heat exchange tube. The heat transfer efficiency can be improved somewhat by swaging a helical groove into the outer tube over a substantial portion of the length of the tube. However, in order to maintain a sufficient gap between adjacent tube walls that provides communication with an open end of a tube so that a fluid leak can be detected, the groove must not be permitted to produce wall to wall contact between adjacent tubes over more than a small portion of the total surface area of a heat exchange tube.

This limitation on adjacent wall direct contact means the heat transfer efficiency remains low when compared to a single wall tube. As a result, either less heat is transferred between the two fluids, thus increasing manufacturing costs, or a larger heat exchange tube surface area must be provided, thus increasing the size and cost of the heat exchanger.

The present invention significantly increases the efficiency of multi-walled heat exchange tubes by inserting a liquid in the gap between adjacent tube walls. The liquid provides a heat transfer efficiency that is far superior to that of the gases that are normally found in the interwall gap. Since the liquid will be pushed out of the gap and detected in the event of a leak in any of the walls of the tube, the safety of the tube is not impaired. If one end of the tube is sealed, the liquid can be inserted by first evacuating the tube and then forcing the liquid into the gap. The seal at the closed end, coupled with the relatively small size of the gap, causes the liquid to be retained within the gap unless forced out by fluid leaking into the gap. It thus becomes possible to significantly reduce the cost of an industrial process by either reducing the heat exchange surface area or by increasing the energy transfer between two heat exchange fluids.

SUMMARY OF THE INVENTION

A high efficiency multi-walled heat exchange tube in accordance with the invention includes inner and outer walls that are sealed closed at one end, open at the opposite end and have a leakage gap between them. A helical groove extends over a substantial length of the tube to produce contact between adjacent walls in the vicinity of the groove while allowing communication through the gap between the open and closed ends of the tube. Heat transfer efficiency through the gap is further improved by filling the gap with a nontoxic silicon oil or other nontoxic liquid having a boiling point above the boiling point of the hottest fluid being used in the heat exchanger.

Apparatus for inserting the liquid into the interwall gap of a heat exchange tube includes a heat insulating housing that receives and supports a plurality of tubes that are sealed at a closed end, a heater connected to direct a flow of hot air into the housing sufficient to heat the tubes to approximately 200 degrees F., a manifold connector assembly sealingly engaging the inner and outer tubes and providing a fluid flow path between the gaps of each of the tubes, a vacuum pump connected through a pump valve to the fluid path to selectively evacuate the fluid flow path and the tube interwall gaps, and a container of liquid oil selectively coupled to the fluid flow path through a source valve to fill the tube gaps with liquid after they have been evacuated. An immersion heater placed in the liquid before filling advantageously heats the liquid to approximately 200 degrees F. to reduce the liquid viscosity and allow the liquid to more completely fill the vacuumized gaps.

Since one end of each tube is sealed and the gaps are rather small, atmospheric pressure retains the liquid within the gaps unless a leak allows additional fluid to enter the gap and force the liquid from the tube. The intergap liquid thus provides a significant increase in heat transfer efficiency without impairing the safety or durability of the heat exchanger in which the enhanced tubes are installed.

BRIEF DESCRIPTION OF THE DRAWINGS

A better understanding of the invention may be had from a consideration of the following Detailed Description, taken in conjunction with the accompanying drawings in which.

DETAILED DESCRIPTION OF THE INVENTION

Figure 1:
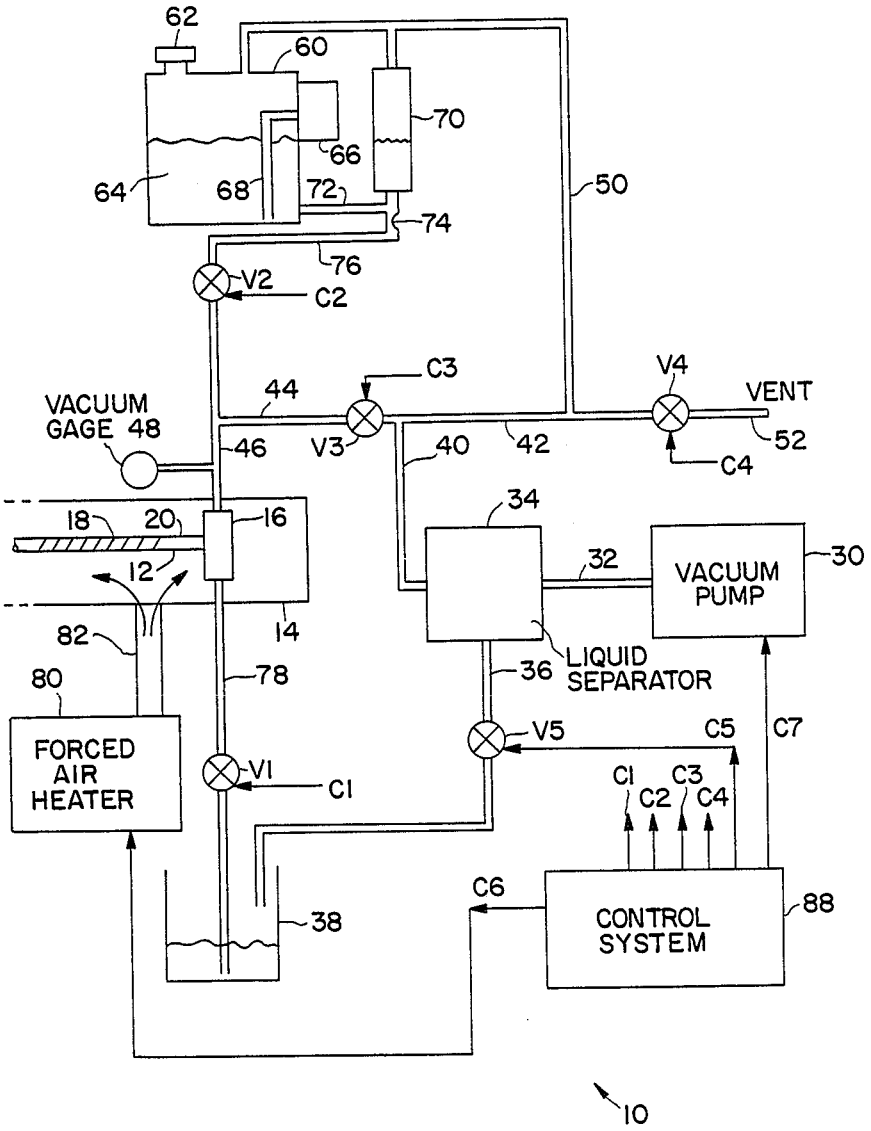
FIG. 1 is a schematic diagram representation of apparatus in accordance with the invention for inserting a liquid oil into an inter-wall gap of a multi-wall heat exchange tube that is sealed at one end.

Referring now to FIG. 1, a system or apparatus 10 for inserting liquid into an inter-wall gap of a multi-wall heat exchanger tube includes one or more multi-wall heat exchanger tubes 12, a thermally insulated housing 14 enclosing the heat exchanger tubes 12, and a manifold connector assembly 16 providing an interconnected fluid flow path to the inter-wall gaps of each of the heat exchange tubes. The manifold connector assembly 16 sealingly engages the outer and inner walls of each heat exchange tube 12 to facilitate first the evacuation of the inter-wall gaps and then the insertion of a liquid therein to improve the heat transfer efficiency for each of the multi-wall tubes 12. Although not explicitly shown in FIG. 1, each tube 12 is sealed by welding, by an expanded bushing or by other suitable means to close each inter-wall gap at a closed end opposite the open end at which the manifold connector assembly is connected. As is known in the art, helical grooves 18 are swaged into the outer surface of the outer tube wall 20 which penetrates into the inner wall of the inner tube to improve heat transfer efficiency by producing a direct contact in the vicinity of the groove 18 between adjacent walls in the multi-wall tube 12.

A vacuum pump 30 is connected by a tube section 32 to a liquid separator 34 which assures that any liquid is separated from air or other gases being evacuated from the one or more tubes 12 before they can flow through tube section 32 and reach vacuum pump 30. A drain tube 36 connects through a valve V5 and extends to a container 38 to permit any liquids collecting within liquid separator 34 to be selectively drained into container 38. Liquid separator 34 also connects through a tube section 40 which in turn connects to a tube section 42. Tube section 42 connects through an electrically controlled valve V3 which in turn connects through a tube segment 44 and a tube segment 46 to the manifold connector assembly 16. A vacuum gage 48 is connected to tube section 46 to monitor the pressure within tube section 46 and hence the connector assembly 16 and the inter-wall gaps of heat exchange tubes 12.

Tube section 42 connects to a tube section 50 and through an electrically controlled valve V4 to a vent pipe 52. It will be apparent that when valve V3 is open and valve V4 is closed, a flow path is provided between vacuum pump 30 and the manifold connector assembly 16 so that vacuum pump 30 may operate to evacuate the inter-wall gaps in the heat exchange tubes 12.

A sealed reservoir 60 is closed by a cap 62 and holds a supply of liquid 64 for improving heat transfer efficiency of the heat exchange tubes 12. The liquid 64 must have a boiling point above the temperatures of any fluids to which the heat exchange tubes 12 will be subjected and must be nontoxic if one of the fluids is to be a human consumable. In an application where potable water is to be heated by a fluid carrying heat from an industrial process, a silicon oil having the commercial designation 200 FL 350 CS has been found to provide the required qualities.

A submersible heater 66 has a submersion heating element 68 extending into the liquid 64 and is operated under thermostat control to maintain the liquid 64 at approximately 200 degrees F.

A stand pipe 70 is connected through tube segment 50 to the top of container 60 and through a tube segment 72 to the bottom of the container 60 and includes a transparent viewing window which enables observation of the fluid level of the liquid 64 within container 60.

The tube segment 72 at the bottom of container 60 is also connected through a constriction 74 and a tube segment 76 to an electrically controlled valve V2. Valve V2 provides a selective coupling of tube segment 76 through tube segment 46 to the manifold connector assembly 16. Hence, after the inter-wall gaps of tubes 12 have been evacuated, they can be filled with the liquid 64 by opening valve V2, closing valve V3, and opening valve V4 to provide communication between the top of container 60 and the vent pipe 52. Atmospheric pressure on the liquid 64 as well as a pressure head of about two feet or more have been found sufficient to then force the liquid 64 into the evacuated inter-wall gaps of the heat exchange tubes 12. It has been found that when valve V2 is first opened, the rush of liquid through tube segment 76 is faster than the rate of supply through tube segment 72 to the bottom of container 60. As a result, the liquid level within stand pipe 70 is temporarily pulled down to the point that air passes through stand pipe 70 into tube segment 76 and the inter-wall gaps of heat exchange tubes 12. The constriction 74 is therefore placed in tube segment 76 to limit this initial surge of fluid and prevent air from entering the tube segment 76. The constriction 74 may be conveniently implemented as simply a small diameter section of tube segment 76.

After the inter-wall gaps of tubes 12 have been filled, valve V2 is closed, valve V3 is open and valve V4 is opened to provide a venting of the tube section 46 and hence the manifold connector assembly 16 to atmosphere. The bottom of manifold connector assembly 16 is connected through a tube segment 78 and an electrically controlled valve V1 to the drain tank 38 so that when valve V1 is open excess fluid is permitted to drain from the manifold connector assembly through tube segment 78 to the container 38. The tubes 12 may then be removed and a new set of tubes installed for evacuation and insertion of a heat exchange enhancement liquid into the inter-wall gaps thereof.

Prior to insertion of the liquid, a forced air heater 80 is operated to provide hot air through a duct 82 to the interior of housing 14 to preheat the heat exchange tubes 12. In one preferred example, the air has a temperature of approximately 220 degrees to enable the heat exchange tubes to be heated to a temperature of approximately 200 degrees Fahrenheit. The tubes and the oil 64 have been found to facilitate insertion of the oil into the inter-wall gaps by thermally expanding the tubes 12 and hence the gaps, by decreasing the density of the air within the gaps and by reducing the viscosity of the liquid oil 64. Heating the tubes 12 prevents the oil from cooling and increasing in viscosity as it fills the tubes 12.

An electrical control system 88 is electrically connected through control signals C1–C7 to control the forced air heater 80, the energization of vacuum pump 30, and the opening and closing of the five valves V1–V5 with control signals C1–C5 respectively. The control system 88 is generally conventional in construction and includes a plurality of cams mounted on a shaft which is subjected to a single rotation for each operating cycle of the apparatus 10. Each cam is shaped to activate a cam follower switch which in turn energizes or de-energizes the signals C1–C7 to control the various components in the apparatus 10. Alternatively, manual switches are provided to manually control the operation of each of the control devices within the apparatus 10.

Figure 2:
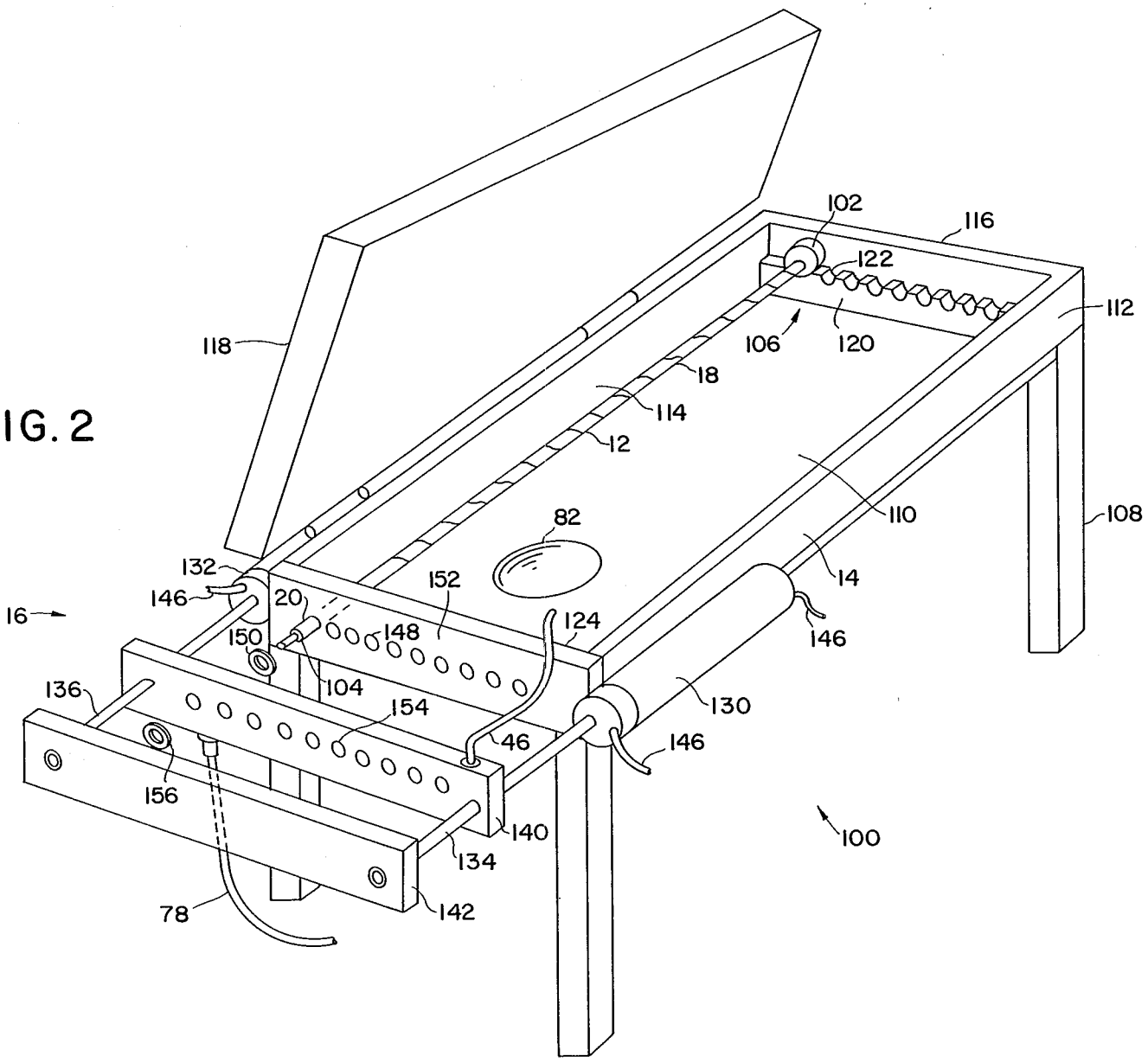
FIG. 2 is a perspective view of a portion of the apparatus shown in FIG. 1 for inserting liquid into a multi-wall heat exchange tube.

A fixture 100 incorporating the housing 14 and manifold connector assembly 16 is shown in FIG. 2 to which reference is now made. The full length of one of the heat exchange tubes 12 is shown in FIG. 2. It will be observed that the closed end is closed by a bushing 102 having a stepped axial bore with a large diameter section which receives the outer wall 20 and a small diameter section which receives an inner wall 104 therethrough. A tool is placed within the inner wall 104 to expand both the inner wall 104 and outer wall 20 against the bushing 102 and create an air tight seal. It will be appreciated that other sealing means such as epoxy bonding, welding or O-ring seals could be utilized if desired to seal the closed end 106 of tube 12. The housing 14 is conveniently mounted on four legs 108 and has a bottom 110 in communication with the duct 82, two side walls 112, 114, an end wall 116 and a lid 118 which is hinged to side wall 114 to provide convenient access to the interior of housing 14. Each of the walls forming the housing 14 is conventionally insulated to reduce heat loss. An aperture (not shown) is formed in the bottom 110 adjacent the end wall 116 to provide an exit for hot air entering through the duct 82. The exit aperture may be advantageously connected to a vent duct if desired. A rack 120 is disposed transversely of the fixture of the housing 14 and provides ten axially extending grooves 122 in the top surface thereof for receiving and supporting the closed ends of ten heat exchange tubes 12.

The front end of housing 14 is closed by a steel front or main plate 124 which has ten axially extending bores therethrough for receiving the open ends of ten heat exchange tubes (only one being shown by way of example in FIG. 2).

A pair of hydraulic ram cylinders 130, 132 are mounted on opposite sides of the housing 14 adjacent the main or front leg 124 and have ram rods 134, 136 respectively which extend slideably through axial bores in opposite ends of a manifold plate 140 to be suitably fastened to opposite ends of an end plate 142. Each of the ram cylinders 130, 132 has an internal cylinder diameter of 1.75 inches and is connected by hydraulic lines 146 at each end thereof to a conventional hydraulic pressure source which maintains a hydraulic pressure of 200 psi. After ten individual tubes are installed in the housing 14 with their open ends extending through the ten apertures 148 through main plate 124, the lid 118 is closed and large O-ring seals 150 are concentrically disposed over the outer wall 20 of each of the tubes 12 and positioned adjacent a front surface 152 of main plate 124. The manifold plate 140 is then slid on ram rods 134, 136 into contact with the large O-rings 150 with the $\frac{3}{4}$ inch large walls 20 of each tube extending partway into apertures 154 in the manifold plate 140 and the small walls 144 extending completely through the apertures 154 (see also FIG. 5). A small O-ring 156 is then concentrically slipped over the end of each $\frac{5}{8}$ inch inner wall 104 and the rams 130, 132 are energized to close the manifold connector assembly by forcing end plate 142 toward the main plate 144 with the manifold plate 140 and O-ring seals 150, 156 sandwiched therebetween. It should be apparent that other tube sizes could be used as well. For example, outer wall diameters of one inch or 1.25 inch are frequently used in heat exchangers.

Figure 3:
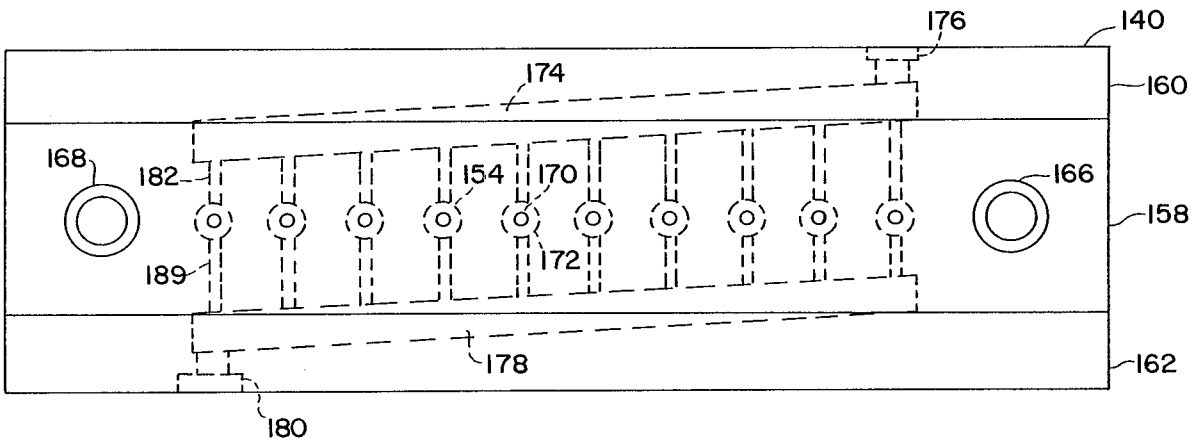
FIG. 3 is a front view of a manifold plate used in a manifold connector assembly used in the apparatus shown in FIG. 1.
Figures 4, 5, 6:
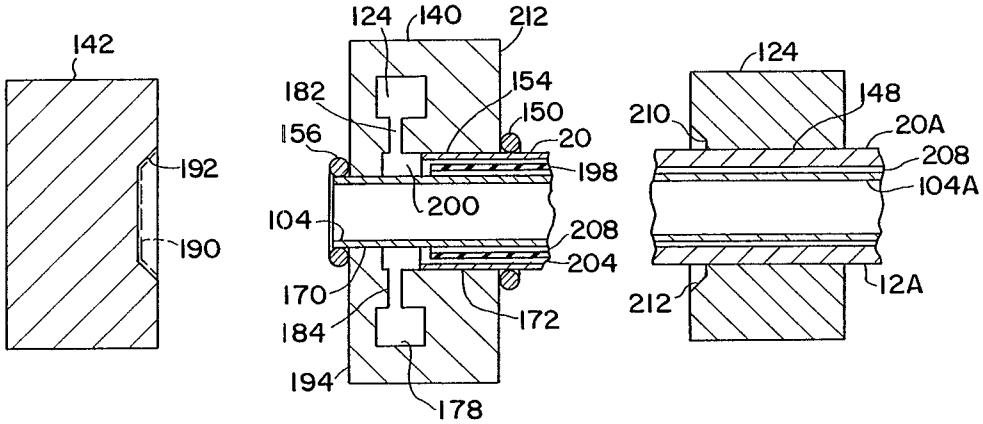
FIG. 4 is a sectional end view of an end plate used in the apparatus shown in FIG. 1.
FIG. 5 is a sectional end view of the manifold plate shown in FIG. 3 in combination with a fragmentary representation of a triple wall tube therein.
FIG. 6 is a sectional end view of a front plate used in the apparatus shown in FIG. 1 with a fragmentary representation of a double wall heat exchange tube inserted therein.

As best seen in FIGS. 3 and 5, the manifold plate 140 comprises a laterally extending center bar 158, and a laterally extending top bar 160 which is welded to the top surface of center bar 158 and a laterally extending bottom bar 162 which is welded to the bottom surface of center bar 158. A pair of bushings 166, 168 extend through the center bar 158 adjacent opposite sides thereof to receive the ram rods 134, 136 respectively.

The ten tube receiving apertures 154 which extend through the manifold plate 140 each have a small diameter portion 170 adjacent the front side of manifold plate 140 and a large diameter portion 172 adjacent the back side of manifold plate 140. A top fluid flow channel 174 is cut partly into the top bar 160 and partly into the bottom bar 158 and extends across the top of all ten tube receiving bores 154. Channel 174 extends with a downward slope from a vacuum port 176 at the right side thereof to facilitate gravity feed of the liquid 64 to all of the tubes 12. A lower fluid flow channel 178 is cut partly into lower bar 62 and partly into upper bar 158 and extends with a downward slope from the vicinity of the right most bore 154 to the left most bore 154 and a drain port 180 adjacent the left-hand end of the channel. The downward slope facilitates the drainage of excess liquid 64 from the manifold plate 140 through drain port 180 and tube segment 78 to the drain container 38. Vertically extending bores 182, 184 provide a fluid flow path between a transition region of the large bore 154 and the upper and lower fluid flow channels 174, 178 respectively. The fluid flow channels 174, 178 and vertical bores 182, 184 thus provide communication between each of the ports 176, 178 and the inter-wall gap of each of the ten heat exchange tubes 12 which are disposed with their open ends extending into the manifold plate 140. It will be apparent that the channels 174 and 178 as well as the bores 182 and 184 may readily be formed before the bars 156, 158 and 160 are welded together.

As best seen in FIG. 4, the end plate 142 has a cavity 190 disposed in opposed relationship to the inner wall 104 of each of the ten heat exchange tubes 12 which may be positioned in the fixture 14. The cavities 130 are each circular in shape and have a 45 degree annular wall 192 which is sized and positioned to matingly engage the small O-ring seals 156 when end plate 142 is forced into a closed position. Making further reference to FIG. 5, as the annular wall 192 engages the small O-ring seal 156, the O-ring seal 156 is forced into sealing engagement with a front surface 194 of manifold plate 140 and simultaneously into sealing engagement with the outer surface of inner tube wall 104.

It will be observed in FIG. 5 that the manifold plate 140 is shown in combination with a triple wall tube having an outer wall 20, an inner wall 104 and a middle wall 198. It will be further observed that the middle wall 198 does not quite extend to the end of outer wall 20 and that the end of outer wall 20 does not quite extend to the end of the large diameter bore section 154. A manifold region 200 thus exists adjacent the end of outer wall 20 to provide communication with the vertical bores 182, 184. An inner gap 202 between inner wall 104 and middle 198 as well as an outer gap 204 between outer wall 20 and middle wall 198 thus remains in communication with the annular manifold 200 and hence the channels 174, 178 and ports 176, 180.

Referring now to FIG. 6, the front plate or main plate 124 has ten equally spaced bores 148 therethrough for receiving the open ends of the ten heat exchange tubes 12. For purposes of illustration, the bores 148 are shown in FIG. 6 as receiving a double walled tube 12A having an outer wall 20A, an inner wall 104A and a single inter-wall gap 208 therebetween. Because the outer diameter of outer walls 20 and 20A remain the same at 0.75 inch, the thickness of outer wall 20A can be somewhat greater than the thickness of triple-wall tube outer wall 20. Since the outer wall 198 of the double-wall tubes 12 does not extend beyond the outer wall 20, the loading of double and triple-wall tubes into the fixture 14 is identical. Main plate 124 has a cavity 210 formed in the front surface thereof concentric with each of the ten bores 148. Each of the cavities 210 has an annular 45 degree side wall chamber 212 which matingly engages the larger O-ring seals 150 when the manifold plate 140 is forced into engagement with the main plate 124. Each circular cavity 210 forces a larger O-ring seal 150 into sealing engagement with a front surface 212 of the manifold plate 140 and simultaneously into sealing engagement with the outer surface of an outer tube wall 20 or 20A. The manifold plate 140 is thus sealing coupled to both the inner wall 104 and the outer wall 20 of each of the ten heat exchange tubes which are to be filled with liquid.

Once the tubes 12 are installed in the fixture 100, the container 60 is filled with an adequate quantity of liquid 64, the heater 66 is turned on and the end plate is closed by the rams 130, 132, the control system 88 is activated to start a multi-step automatic process. During a startup step the forced air heater 80 is turned on to begin heating the heat exchange tubes 12 and valve V1 is opened to assure that any excess liquid 64 from a previous operation is drained from the manifold 140 and tube segment 78. The vacuum pump 30 remains off and all other valves V2–V5 are closed. The startup step lasts for about one minute.

At the end of the startup step a vacuum step begins. At the beginning of the vacuum step the following events occur in sequence. The drain valve V1 is closed, valve V3 is opened to open a path between manifold plate 140 and the vacuum pump and vent valve V4 is opened so that vacuum pump 30 does not have to start under load. Next, vacuum pump 30 is started and then vent valve V4 is closed. Vacuum pump 30 now begins to pull a vacuum on the container 60, the manifold plate 140 and the inter-wall gaps themselves. Valves V2 and V5 remain closed. The vacuum step continues for a sufficient period of time for the system pressure to be pulled down to approximately 0.0000003 in Hg. A time period of approximately 10 to 15 minutes has been found sufficient to pull an adequate vacuum and heat the tubes 12. It appears that a vacuum of 0.49 to 1.49 or better is required to substantially fill the inter-wall gaps with the liquid 64 and optimize the heat transfer capacity of the multi-wall tubes 12. During the vacuum step container 64 is evacuated along with the tube gaps. This assures that any air is removed from the liquid oil 64 and cannot flow back into the inter-wall gaps with the oil 64.

A fill tubes step is next executed at the end of the vacuum step. During the fill tubes step the following sequence of events occurs. First the valve V3 is closed to isolate the gaps from the vent 52. Second, fill valve V2 is opened to allow liquid 64 to begin running into the manifold 140 and the inter-wall gaps in the heat exchange tubes 12. Third the vent valve V4 is opened to introduce atmospheric pressure to the liquid container 60. The resulting atmospheric pressure combines with a pressure head of about 2 feet produced by elevating the container above the tubes 12 to force the liquid 64 into the inter-wall gaps of the heat exchange tubes 12. Finally, the vacuum pump is turned off and the forced air heater is turned off to allow the tubes 12 to begin to cool. The fill tubes step continues for approximately 12 minutes while the liquid 64 fills the inter-wall gaps. During this time the cooling of the tubes 12 tends to reduce the size of the inter-wall gaps, thus forcing out excess liquid 64 and making drainage of further liquid from the tiny gaps more difficult.

Finally, a 3 minute drain cycle is initiated. During the drain cycle fill valve V2 is closed and then drain valve V1 is opened to drain excess liquid 64 from the manifold plate 140 into drain container 38. Valve V3 is then opened while vent valve V4 remains open to connect the fill side of manifold plate 140 to atmosphere and assure that proper drainage can occur. Valve V5 is then opened to drain any liquid accumulated in liquid separator 34 into the drain container 38. The forced air heater 80 remains off.

In practice it has proven convenient to simply pour any contents of the drain container 38 back into the source container 60 at the end of each gap fill cycle. However, the system 10 is designed to automatically transfer the drainage fluid back to container 60 using the vacuum pump 30. This is accomplished by opening valves V1 and V2 and starting vacuum pump 30 while valves V3, V4 and V5 remain closed. This configuration pulls a vacuum on the container 60 and causes drain liquid to be drawn under atmospheric pressure from drain container 38 upward through valve V1, manifold plate 140 and valve V2 to the container 60. When the excess drain liquid has been returned to container 60 the vacuum pump 30 is turned off, fill valve V2 is closed to retain the liquid within container 60 and all valves V1, V3, V4 and V5 are opened to allow any liquid within the system to drain back into the container 38.

While there have been shown and described herein an improved multi-wall heat exchanger tube and a method and apparatus for manufacturing the tube for the purpose of enabling a person of ordinary skill in the art to make and use the invention, it should be appreciated that the invention is not limited thereto. Accordingly, any modifications, variations or equivalent arrangements within the scope of the attached claims should be considered to be within the scope of the invention.

What is claimed is:

1. A method of manufacturing a high efficiency multi-wall heat exchange tube comprising the steps of:

inserting an inner wall inside of an outer wall to form a gap therebetween;

sealing the outer wall to the inner wall to close the gap at one end of the heat exchange tube while leaving the gap open at an end opposite the one end;

evacuating the gap through the open end of the heat exchange tube opposite the one end; and inserting a liquid with a boiling point above a maximum operating temperature of the heat exchange tube into the evacuated gap through the open end of the heat exchange tube until the gap is substantially filled with the liquid.

2. A method of manufacturing a high efficiency multi-wall heat exchange tube according to claim 1 further comprising the step of heating the heat exchange tube before inserting the liquid into the evacuated gap.

3. A method of manufacturing a high efficiency multi-wall heat exchange tube according to claim 2 further comprising the step of heating the liquid before inserting the liquid into the evacuated gap.

4. A method of manufacturing a high efficiency multi-wall heat exchange tube according to claim 3 wherein the tube and the liquid are both heated to a temperature of approximately 200 degrees F. before the liquid is inserted into the gap.

5. A method of manufacturing a high efficiency multi-wall heat exchange tube according to claim 4 further comprising the step of placing the tube within an enclosure before heating the tube.

6. A method of manufacturing a high efficiency multi-wall heat exchange tube comprising the steps of:

inserting an inner wall inside of an outer wall to form a gap therebetween;

sealing the outer wall to the inner wall to close the gap at one end of the heat exchange tube;

evacuating the gap through an open end of the heat exchange tube opposite the one end;

inserting a liquid into the evacuated gap through the open end of the heat exchange tube until the gap is substantially filled with the liquid; and placing the tube into a fixture, the fixture having a cavity that receives the tube and is connectable to receive heating fluid, the fixture further including a connector assembly for connecting the open end of the heat exchange tube to a source of vacuum and to a source of the liquid, the connector assembly including a main plate closing an end of the cavity and having an aperture therethrough which receives the outer wall therethrough, a manifold having a stepped bore therethrough which receives the open end of the tube and extends over a transition from the outer wall to the inner wall, the manifold having an internal passageway therein which provides communication between the gap and a first port that is connectable to a source of vacuum and between the gap and a second port that is connectable to a source of the liquid, the connector assembly further including a first O-ring seal disposed about the outer wall between the main plate and the manifold to seal an outer surface of the outer wall relative to the main plate and the manifold, an end cap disposed adjacent the manifold on a side thereof opposite the main plate, and a second O-ring seal disposed between the manifold and the inner wall to seal an outer surface of the inner wall relative to the manifold and the end cap.

7. A method of manufacturing a high efficiency multi-wall heat exchange tube according to claim 6 wherein the tube is a double walled tube.

8. A method of manufacturing a high efficiency multi-wall heat exchange tube according to claim 6 wherein the tube is a triple walled tube.

* * * * *